US009205655B2

(12) United States Patent
Sawase

(10) Patent No.: US 9,205,655 B2
(45) Date of Patent: Dec. 8, 2015

(54) IMAGE FORMING APPARATUS

(71) Applicant: Hiroshi Sawase, Kanagawa (JP)

(72) Inventor: Hiroshi Sawase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/682,606

(22) Filed: Apr. 9, 2015

(65) Prior Publication Data

US 2015/0306878 A1 Oct. 29, 2015

(30) Foreign Application Priority Data

Apr. 24, 2014 (JP) ..... 2014-089802

(51) Int. Cl.
*B41J 2/165* (2006.01)

(52) U.S. Cl.
CPC ..... *B41J 2/16505* (2013.01); *B41J 2/165* (2013.01); *B41J 2/1652* (2013.01)

(58) Field of Classification Search
CPC ..... B41J 2/165; B41J 2/16505; B41J 2/1652
See application file for complete search history.

(56) References Cited

U.S. PATENT DOCUMENTS

| | | | | |
|---|---|---|---|---|
| 2008/0291240 | A1 | 11/2008 | Ohsako et al. | |
| 2009/0225133 | A1* | 9/2009 | Yokouchi | 347/47 |
| 2011/0063353 | A1* | 3/2011 | Takeuchi et al. | 347/14 |
| 2013/0033536 | A1 | 2/2013 | Sawase | |
| 2013/0222460 | A1 | 8/2013 | Sawase | |

FOREIGN PATENT DOCUMENTS

| | | |
|---|---|---|
| JP | 2005-059385 | 3/2005 |
| JP | 2006-159717 | 6/2006 |
| JP | 2008-290400 | 12/2008 |
| JP | 2009-143154 | 7/2009 |

* cited by examiner

*Primary Examiner* — Lisa M Solomon
(74) *Attorney, Agent, or Firm* — Cooper & Dunham LLP

(57) ABSTRACT

An image forming apparatus includes a liquid ejection head, a cap, and a dummy discharge controller. The liquid ejection head has plural nozzle rows in a nozzle formed face thereof. Each of the plural nozzle rows includes multiple nozzles through which droplets are discharged. The cap caps the nozzle formed face of the liquid ejection head. The dummy discharge controller controls a dummy discharge operation to discharge dummy discharge droplets not contributing to image formation from the nozzles with the nozzle formed face opposed to the cap. The dummy discharge controller controls the liquid ejection head to discharge the dummy discharge droplets at different timings between adjacent nozzle rows of the plural nozzle rows in the dummy discharge operation.

4 Claims, 12 Drawing Sheets

IMAGE FORMING APPARATUS

CROSS-REFERENCE TO RELATED APPLICATIONS

This patent application is based on and claims priority pursuant to 35 U.S.C. §119(a) to Japanese Patent Application No. 2014-089802, filed on Apr. 24, 2014 in the Japan Patent Office, the entire disclosure of which is hereby incorporated by reference herein.

BACKGROUND

1. Technical Field

Embodiments of this disclosure relate to an image forming apparatus.

2. Description of the Related Art

As one type of image forming apparatus, an image forming apparatus according to a liquid discharge recording method, for example, an inkjet recording apparatus is known that employs a liquid discharge head (droplet discharge head) for discharging droplets as a recording head.

For example, an image forming apparatus performs dummy discharge operation in which dummy discharge droplets not contributing to image formation are discharged from a liquid discharge head. For the dummy discharge operation, an image forming apparatus discharges dummy discharge droplets from a liquid discharge head into a cap for capping a nozzle formed face of the liquid discharge head. Alternatively, dummy discharge droplets may be discharged into a cap to maintain the moisture of an absorber in the cap.

SUMMARY

In at least one embodiment of the present disclosure, there is provided an image forming apparatus including a liquid ejection head, a cap, and a dummy discharge controller. The liquid ejection head has plural nozzle rows in a nozzle formed face thereof. Each of the plural nozzle rows includes multiple nozzles through which droplets are discharged. The cap caps the nozzle formed face of the liquid ejection head. The dummy discharge controller controls a dummy discharge operation to discharge dummy discharge droplets not contributing to image formation from the nozzles with the nozzle formed face opposed to the cap. The dummy discharge controller controls the liquid ejection head to discharge the dummy discharge droplets at different timings between adjacent nozzle rows of the plural nozzle rows in the dummy discharge operation.

In at least one embodiment of the present disclosure, there is provided an image forming apparatus including a liquid ejection head, a cap, and a dummy discharge controller. The liquid ejection head has plural nozzle rows in a nozzle formed face thereof. Each of the plural nozzle rows includes multiple nozzles through which droplets are discharged. The cap caps the nozzle formed face of the liquid ejection head. The dummy discharge controller controls a dummy discharge operation to discharge dummy discharge droplets not contributing to image formation from the nozzles with the nozzle formed face opposed to the cap. The dummy discharge controller controls the liquid ejection head to perform the dummy discharge operation in nozzle groups, each of the nozzle groups including two or more nozzles, and to discharge the dummy discharge droplets at different timings between nozzle groups of adjacent nozzle rows of the plural nozzle rows in the dummy discharge operation.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
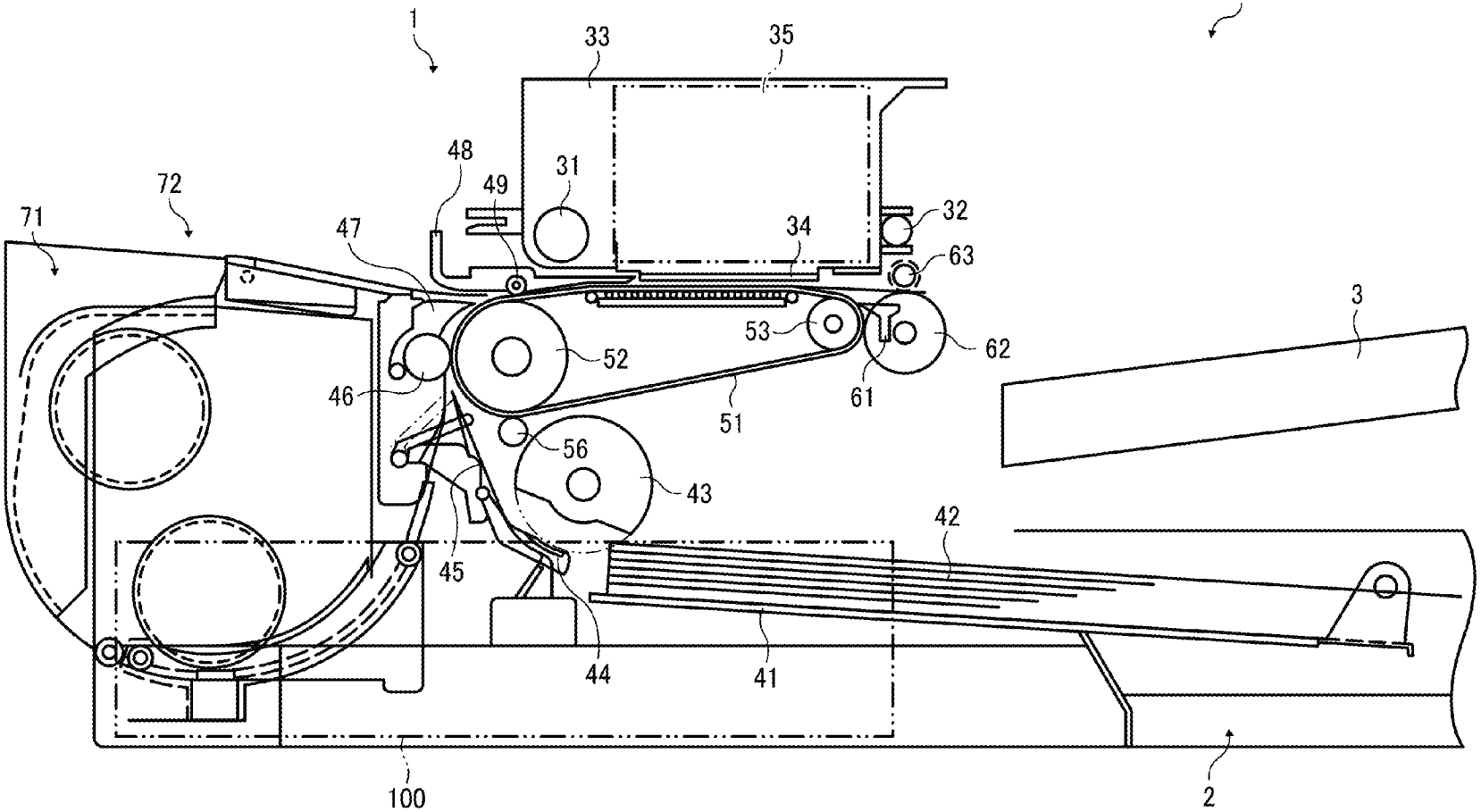
FIG. 1 is a side view of a mechanical section of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and is anything to which liquid droplets can be attached. The term "sheet" is used as a generic term including a recorded medium, a recording medium, a recording sheet, and a recording sheet of paper. The terms "image formation", "recording", "printing", and "image printing" are used herein as synonyms for one another.

The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Although the embodiments are described with technical limitations with reference to the attached drawings, such description is not intended to limit the scope of the disclosure and all of the components or elements described in the embodiments of this disclosure are not necessarily indispensable.

Figure 2:
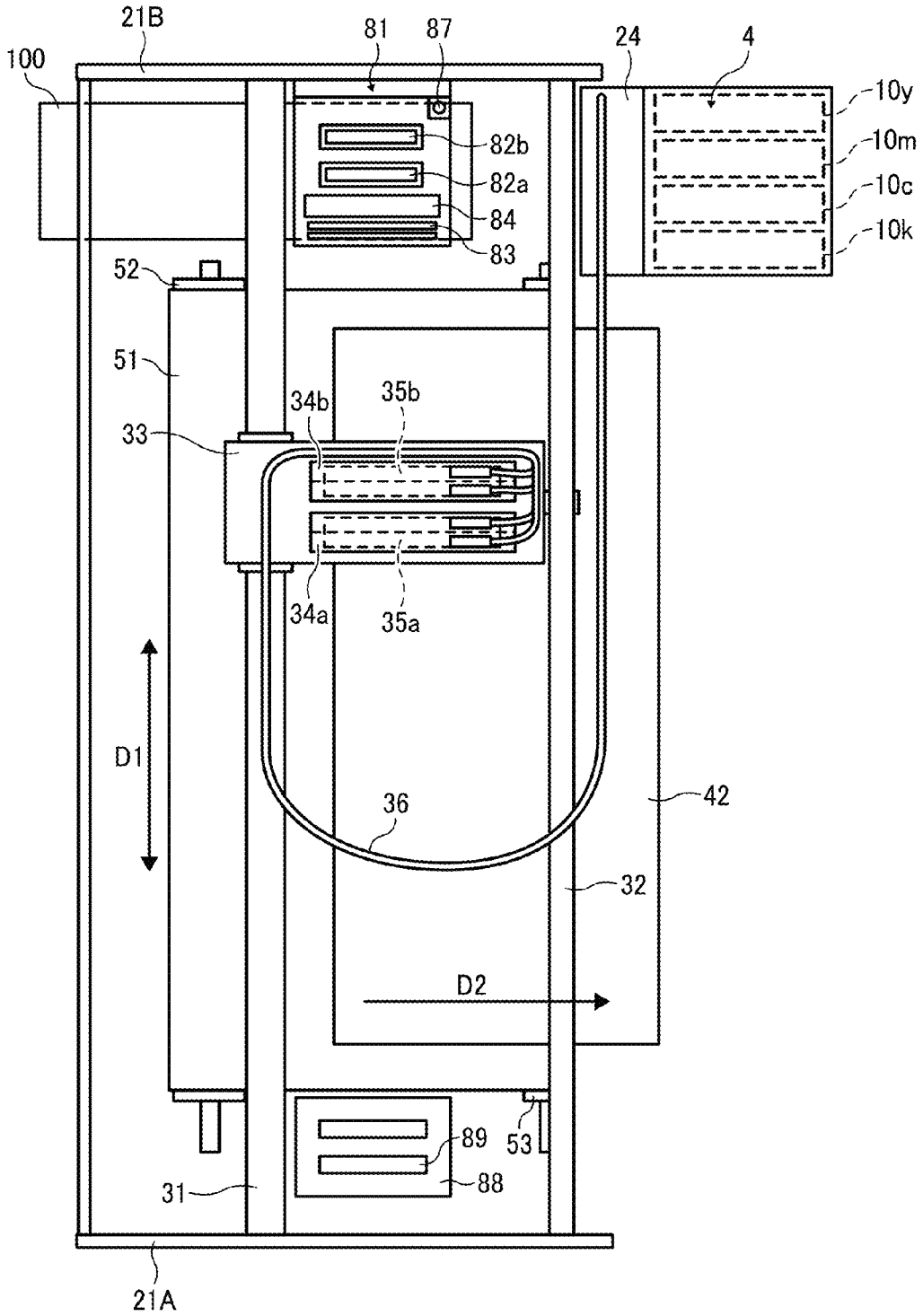
FIG. 2 is a partial plan view of the mechanical section of FIG. 1.

Hereinafter, embodiments of the present disclosure will be described with reference to the attached drawings. First, an image forming apparatus according to an embodiment of this disclosure is described with reference to FIGS. 1 and 2. FIG. 1 is a side view of an image forming apparatus 1000 according to an embodiment of this disclosure. FIG. 2 is a plan view of the image forming apparatus illustrated in FIG. 1.

In FIG. 1, the image forming apparatus 1000 is a serial-type inkjet recording apparatus. A main guide rod 31 and a sub-guide rod 32 serving as guides are laterally bridged between side plates 21A and 21B of an apparatus body 1 to support a carriage 33 slidably in a main scanning direction indicated by arrow D1 in FIG. 2. A main scanning motor reciprocally moves the carriage 33 in the main scanning direction D1.

The carriage 33 mounts recording heads 34*a* and 34*b* (collectively referred to as "recording heads 34" unless distinguished) serving as liquid discharge heads for discharging ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arrayed in a direction (sub-scanning direction) indicated by arrow D2 perpendicular to the main scanning direction D1 and ink droplets are discharged downward from the nozzles.

Each of the recording heads 34 includes two nozzle rows. For example, one of the nozzle rows of the recording head 34*a* discharges droplets of black (K) and the other discharges droplets of cyan (C). In addition, one of the nozzle rows of the recording head 34*b* discharges droplets of magenta (M) and the other discharges droplets of yellow (Y). In some embodiments, a recording head 34 has a single surface of a nozzle plate in which multiple rows, each including multiple nozzles, are arrayed corresponding to respective colors.

The carriage 33 mounts head tanks 35*a* and 35*b* (collectively referred to as "head tanks 35" unless distinguished) serving as a second ink supply to supply the respective color inks to the corresponding nozzle rows of the recording heads 34. Ink cartridges (main tanks) 10*y*, 10*m*, 10*c*, and 10*k* corresponding to Y, M, C, and K colors, respectively, are detachably mounted to a cartridge mount 4. A supply pump unit 24 replenishes and supplies respective color inks from the ink cartridges 10 to head tanks 35 via supply tubes 36.

The image forming apparatus 1000 further includes a sheet feeder to feed sheets 42 stacked on a sheet stacker (pressure plate) 41 of a sheet feed tray 2. The sheet feeder further includes a sheet feed roller 43 and a separation pad 44. The sheet feed roller 43 has, e.g., a substantially half moon shape to separate and feed the sheets 42 sheet by sheet from the sheet stack portion 41. The separation pad 44 is disposed opposing the sheet feed roller 43 and urged toward the sheet feed roller 43.

To feed a sheet 42 fed from the sheet feeder to a position below the recording heads 34, the image forming apparatus 1000 includes a first guide 45 to guide the sheet 42, a counter roller 46, a conveyance guide 47, and a pressing member 48 including a leading-edge press roller 49. The image forming apparatus 1000 also includes a conveyance belt 51 serving as a conveyor to electrostatically attract the sheet 42 thereon and convey the sheet 42 to a position opposing the recording heads 34.

The conveyance belt 51 is an endless belt entrained around a conveyance roller 52 and a tension roller 53 so as to circulate in a belt conveyance direction (sub-scanning direction) indicated by arrow D2 in FIG. 2. The image forming apparatus 1000 also has a charging roller 56 serving as a charger to charge a surface layer of the conveyance belt 51. The charging roller 56 is disposed so as to contact an outer surface of the conveyance belt 51 and rotate with circulation of the conveyance belt 51. A sub-scanning motor rotates the conveyance roller 52 via a timing belt to circulate the conveyance belt 51 in the belt conveyance direction D2.

The image forming apparatus 1000 further includes a sheet ejector to eject the sheet 42 on which an image has been formed by the recording heads 34. The sheet ejector includes a separation claw 61 to separate the sheet 42 from the conveyance belt 51, a first ejection roller 62, a spur 63 serving as a second ejection roller, and a sheet ejection tray 3 disposed at a position lower than the first ejection roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A manual-feed tray 72 is formed at an upper face of the duplex unit 71.

As illustrated in FIG. 2, a maintenance assembly (maintenance and recovery assembly) 81 is disposed in a non-printing area (non-recording area) at one end in the main scanning direction D1 of the carriage 33. The maintenance assembly 81 maintains and recovers nozzle conditions of the recording heads 34. The maintenance assembly 81 includes, for example, a suction cap 82*a*, a moisture-retention cap 82*b* (the suction cap 82*a* and the moisture-retention cap 82*b* are also referred to as caps 82 unless distinguished), and a wiper (wiper blade) 83. The suction cap 82*a* caps the surface of the nozzle plate of any one of the recording heads 34 to suck ink from the nozzles. The suction cap 82*a* also caps the surface of the nozzle plate of any one of the recording heads 34 for moisture retention. The moisture-retention cap 82*b* caps the surface of the nozzle plate of any one of the recording heads 34 for moisture retention. The wiper 83 wipes the surface of the nozzle plate of the recording head 34.

The maintenance assembly 81 further includes a first dummy-discharge receptacle 84 and a carriage lock 87. The first dummy-discharge receptacle 84 receives droplets discharged by dummy discharge in which droplets not contributing to image recording are discharged to remove thickened recording liquid. The carriage lock 87 locks the carriage 33. Below the maintenance assembly 81, a waste liquid tank 100 is removably mounted to the apparatus body 1 to store waste ink or liquid discharged by the maintenance and recovery operation.

As illustrated in FIG. 2, a second dummy-discharge receptacle 88 is disposed at a non-printing area on the opposite end in the main scanning direction D1 of the carriage 33. The second dummy-discharge receptacle 88 receives droplets discharged, e.g., during recording (image forming) operation by dummy discharge in which droplets not contributing to image recording are discharged to remove thickened recording liquid. The second dummy-discharge receptacle 88 has openings 89 arranged in parallel to the nozzle rows of the recording heads 34.

In the image forming apparatus 1000 having the above-described configuration, the sheets 42 are separated sheet by sheet from the sheet feed tray 2, fed in a substantially vertically upward direction, guided along the first guide 45, and conveyed while being sandwiched between the conveyance belt 51 and the counter roller 46. Further, a leading edge of the sheet 42 is guided by the conveyance guide 47 and is pressed against the conveyance belt 51 by the leading-edge press roller 49 to turn a conveyance direction of the sheet 42 by approximately 90°.

At this time, the conveyance belt 51 is charged in alternating charge voltage pattern with the charging roller 56. When the sheet 42 is fed onto the conveyance belt 51 charged, the sheet 42 is attracted onto the conveyance belt 151 and conveyed in the sub-scanning direction D2 by circulation of the conveyance belt 51.

By driving the recording heads 34 in accordance with image signals while moving the carriage 33, ink droplets are discharged onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation finishes and the sheet 42 is output to the sheet ejection tray 3.

Figure 3:
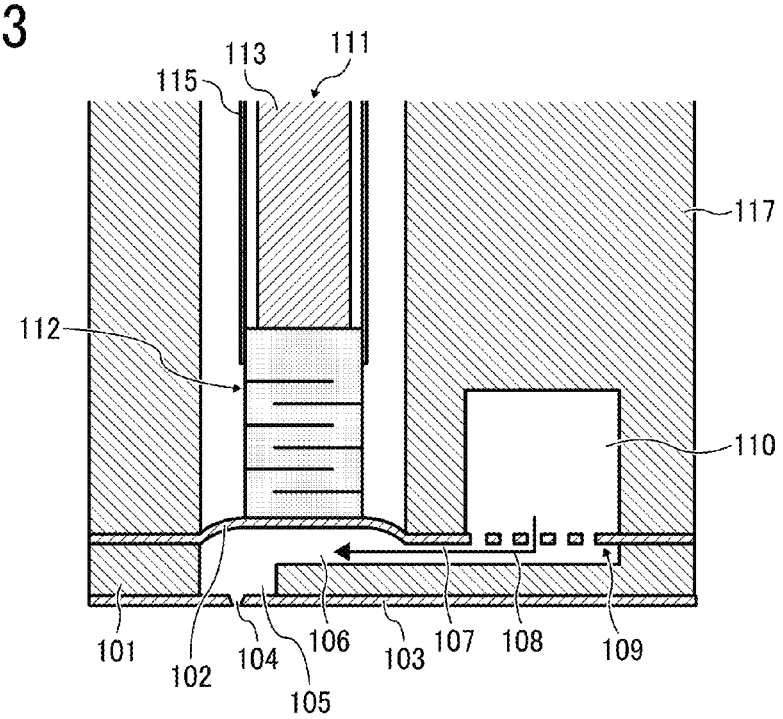
FIG. 3 is a cross-sectional view of a liquid discharge head forming a recording head of the image forming apparatus cut along a longitudinal direction of a chamber.
Figure 4:
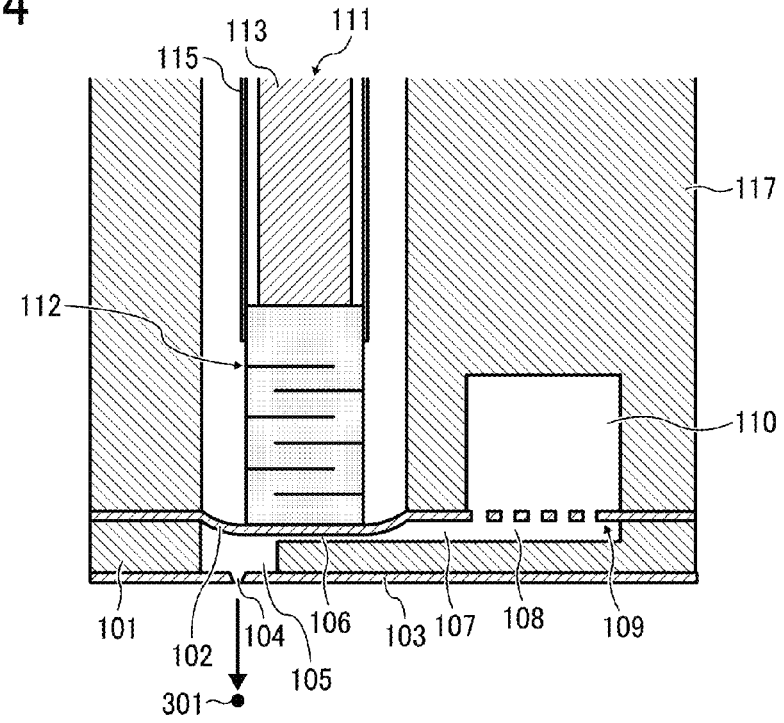
FIG. 4 is a cross-sectional view of the recording head in droplet discharge operation.

Next, an example of the recording head 34 serving as a liquid discharge head is described with reference to FIGS. 3 and 4. FIGS. 3 and 4 are cross-sectional views of the recording head 34 cut along a longitudinal direction of an individual chamber 106 (perpendicular to a nozzle array direction in which nozzles are arrayed in row).

In the recording head 34, a channel plate 101, a diaphragm 102, and a nozzle plate 103 are joined together. Thus, individual chambers 106, fluid resistant portions 107, and liquid introduction portions 108 are formed in the joined plates. Each individual chamber 106 is communicated with a nozzle 104 through which to discharge droplets. The fluid resistant portion 107 supplies liquid to the individual chamber 106. A frame member 117 of the recording head 34 includes a common chamber 110 from which liquid is introduced into each liquid introduction portion 108 via a filter 109. Liquid is supplied from the liquid introduction portion 108 to the individual chamber 106 via the fluid resistant portion 107. The term "individual chamber" used herein includes, e.g., pressurization chamber, pressurization liquid chamber, pressure chamber, individual channel, and pressure generating chamber.

The channel plate 101 is formed by laminating metal plates made of, e.g., stainless used steel (SUS) so as to have openings and channels, such as through holes 105, the individual chambers 106, the fluid resistant portions 107, and the liquid introduction portions 108. The diaphragm 102 is a wall member constituting a wall face of each of, e.g., the individual chambers 106, the fluid resistant portions 107, and the liquid introduction portions 108. In addition, the filters 109 are formed in the diaphragm 102. It is to be noted that, instead of laminating metal plates of, e.g., SUS, the channel plate 101 may be formed by, for example, anisotropically etching a silicon substrate.

Pillar-shaped, laminated piezoelectric members 112 are bonded to a first face of the diaphragm 102 that is opposite to a second face of the diaphragm 102 facing the individual chambers 106. The piezoelectric members 112 serve as actuators (pressure generators) to generate energy for applying pressure to ink in the individual chambers 106 to discharge droplets from the nozzles 104. One end of each piezoelectric member 112 is bonded to a base 113, and flexible printed cables (FPCs) 115 are connected to the piezoelectric member 112 to transmit driving waveform, thus forming a piezoelectric actuator 111.

In this example, the piezoelectric member 112 is used in, for example, a d33 mode to extend and contract in a direction (laminated direction) in which the metal plates are laminated. Alternatively, the piezoelectric member 112 may be used in, for example, a d31 mode to extend and contract in a direction perpendicular to the laminated direction.

In the recording head 34 having the above-described configuration, for example, as illustrated in FIG. 3, by reducing a voltage applied to the piezoelectric member 112 below a reference potential, the piezoelectric member 112 contracts to deform the diaphragm 102. As a result, the volume of the individual chamber 106 increases, thus causing ink to flow into the individual chamber 106.

Then, as illustrated in FIG. 4, by increasing the voltage applied to the piezoelectric member 112 above the reference potential, the piezoelectric member 112 extends in the laminated direction to deform the diaphragm 102 toward the nozzle 104, thus decreasing the volume of the individual chamber 106. As a result, pressure is applied to ink in the individual chamber 106, thus discharging a liquid droplet 301 from the nozzle 104.

Then, by returning the voltage applied to the piezoelectric member 112 to the reference potential, the diaphragm 102 returns to its original position. As a result, the individual chamber 106 expands and a negative pressure occurs in the individual chamber 106, thus replenishing ink from the common chamber 110 to the individual chamber 106. After vibration of a meniscus surface of the nozzle 104 decays to a stable state, the process shifts to an operation for the next droplet discharge.

Figure 5:
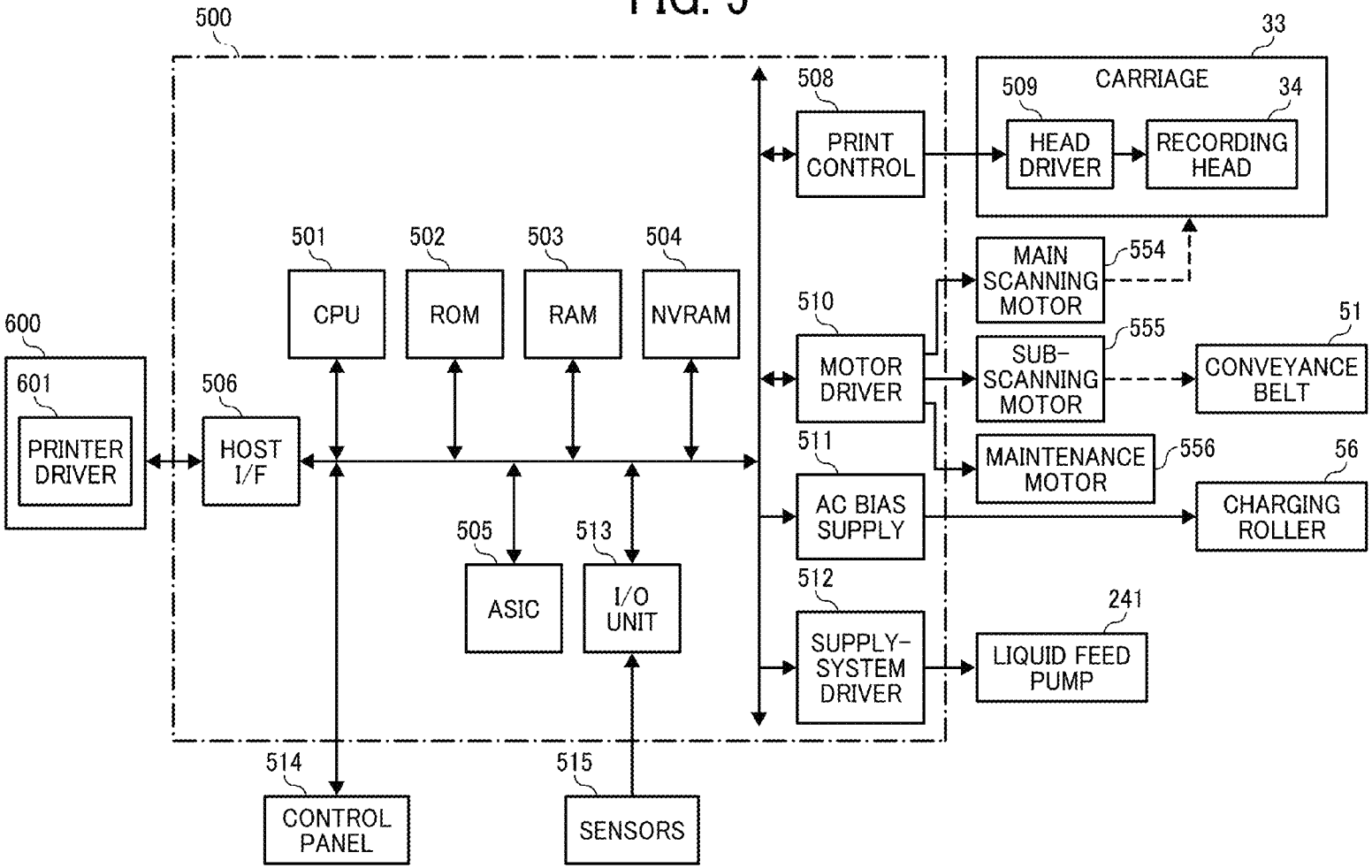
FIG. 5 is a block diagram of a controller of the image forming apparatus.

Next, an outline of a controller of the image forming apparatus 1000 is described with reference to FIG. 5. FIG. 5 is a block diagram of a controller 500 of the image forming apparatus 1000.

The controller 500 includes a central processing unit (CPU) 501, a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus 1000 and serves as a control according to at least one embodiments of this disclosure to control dummy discharge operation. The ROM 502 stores fixed data, such as various programs including programs executed by the CPU 501, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control 508 and a head driver (driver integrated circuit) 509. The print control 508 includes a data transmitter and a driving signal generator to drive and control the recording heads 34. The head driver 509 drives the recording heads 34 mounted on the carriage 33. The controller 500 further includes a main scanning motor 554, a sub-scanning motor 555, and a motor driver 510. The main scanning motor 554 moves the carriage 33 for scanning, and the sub-scanning motor 555 circulates the conveyance belt 51. The motor driver 510 drives a maintenance motor 556 of the maintenance assembly 81 to move the caps 82 and the wiper 83 of the maintenance assembly 81 or suck ink with the suction pump 812. The controller 500 further includes an alternating-current (AC) bias supply 511 and a supply-system driver 512. The AC bias supply 511 supplies AC bias to the charging roller 56. The supply-system driver 512 drives liquid feed pumps 241 of the supply pump unit 24.

The controller 500 is connected to a control panel 514 for inputting and displaying information necessary to the image forming apparatus 1000.

The controller 500 includes a host interface (I/F) 506 for transmitting and receiving data and signals to and from a host 600, such as an information processing device (e.g., personal computer), an image reading device, or an image pick-up device, via a cable or network.

The CPU 501 of the controller 500 reads and analyzes print data stored in a reception buffer of the I/F 506, performs desired image processing, data sorting, or other processing with the ASIC 505, and transfers image data from the print control 508 to the head driver 509. For example, a printer driver 601 of the host 600 or the controller 500 creates dot-pattern data for image output.

The print control 508 transfers the above-described image data as serial data and outputs to the head driver 509, for example, transfer clock signals, latch signals, and control signals required for the transfer of image data and determination of the transfer. In addition, the print control 508 includes the driving signal generator including, e.g., a digital/analog (D/A) converter (to perform digital/analog conversion on pattern data of driving pulses stored on the ROM 502), a voltage amplifier, and a current amplifier. The print control 508 outputs a driving signal containing one or more driving pulses from the driving signal generator to the head driver 509.

In accordance with serially-inputted image data corresponding to one line recorded by the recording heads 34, the head driver 509 selects driving pulses of a driving waveform transmitted from the print control 508 and applies the selected driving pulses to the piezoelectric member 112 serving as the pressure generator to drive the recording heads 34. Thus, the recording heads 34 are driven. At this time, by selecting a part or all of the driving pulses forming the driving waveform or a part or all of waveform elements forming a driving pulse, the recording heads 34 can selectively discharge dots of different sizes, e.g., large droplets, medium droplets, and small droplets.

An input/output (I/O) unit 513 acquires data from sensors 515 mounted in the image forming apparatus 1000, extracts data required for controlling printing operation, and controls the print control 508, the motor driver 510, and the AC bias supply 511. The sensors 515 include, for example, an optical sensor to detect a position of a sheet of recording media, a thermistor to monitor internal temperature and/or humidity of the image forming apparatus 1000, a voltage sensor to monitor the voltage of the conveyance belt 51 charged, and an interlock switch to detect the opening and closing of a cover. The I/O unit 513 is capable of processing various types of data transmitted from the sensors.

Figure 6:
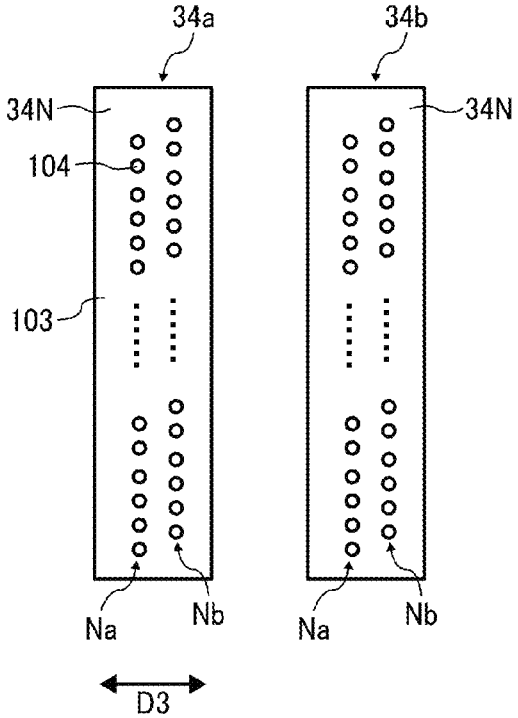
FIG. 6 is a plan view of nozzle rows of a recording head in a first embodiment of this disclosure, seeing from a nozzle formed face side thereof.
Figure 7A:
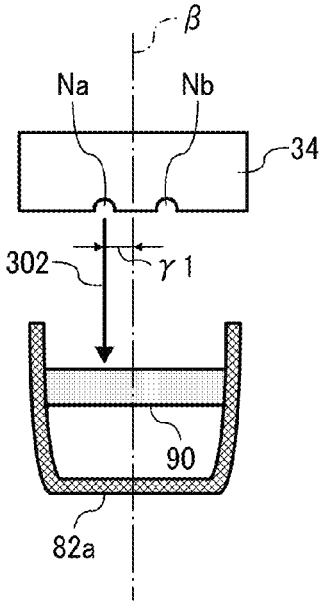
FIGS. 7A and 7B are schematic views of in-cap dummy discharge operation.
Figure 7B:
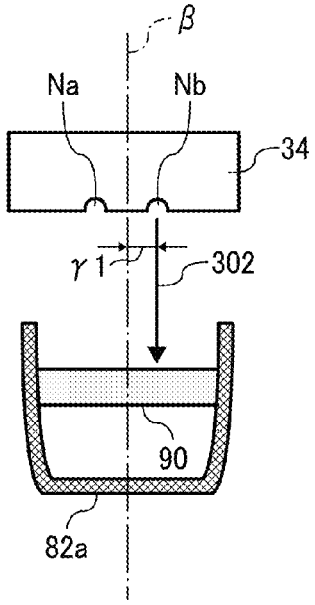
Figure 8:
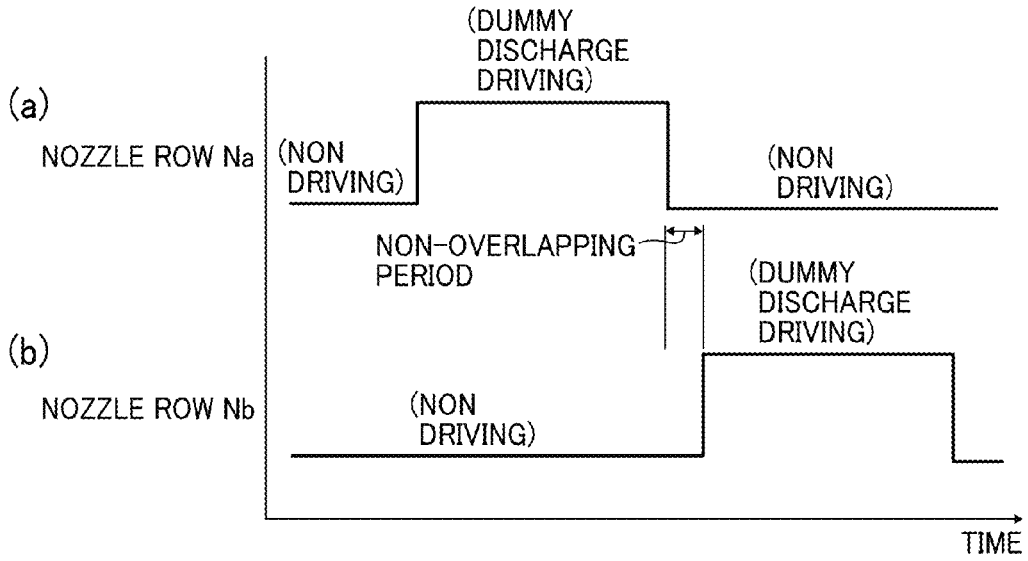
FIG. 8 is a timing chart of the in-cap dummy discharge operation.

Next, in-cap dummy discharge operation in a first embodiment of the present disclosure is described with reference to FIGS. 6 to 8. FIG. 6 is a plan view of nozzle formed faces 34N of recording heads 34*a* and 34*b* (also referred to as recording heads 34 unless distinguished) according to an embodiment of this disclosure. FIGS. 7A and 7B are schematic views of in-cap dummy discharge operation. FIG. 8 is a timing chart of the in-cap dummy discharge operation.

Each of the recording heads 34 includes two nozzle rows Na and Nb, in each of which multiple nozzles 104 are arrayed. Here, a direction (nozzle-row arranged direction) indicated by arrow D3 in which the nozzle rows Na and Nb are arranged side by side each other is a movement direction of the carriage 33 which is the main scanning direction D1).

As illustrated in FIG. 7, the suction cap 82*a* includes an absorber 90 therein.

Hence, in this embodiment, the in-cap dummy discharge operation is performed to retain moisture in the absorber 90 of the cap 82*a*. Dummy discharge operation for maintaining or recovering the performance of the recording head 34 can also be performed into the suction cap 82*a*.

To perform in-cap dummy discharge operation, the recording head 34 is moved to oppose the suction cap 82*a*.

For example, as illustrated in FIG. 8A, dummy discharge operation (dummy discharge driving) is performed on the nozzle row Na to discharge dummy discharge droplets 302 not contributing to image formation from each nozzle of the nozzle row Na as illustrated in FIG. 7A. At this time, as illustrated in FIG. 8B, dummy discharge is not performed on the nozzle row Nb (dummy discharge non-driving).

Then, as illustrated in FIG. 8B, dummy discharge operation (dummy discharge driving) is performed on the nozzle row Nb to discharge dummy discharge droplets 302 not contributing to image formation from each nozzle of the nozzle row Nb as illustrated in FIG. 7B. At this time, as illustrated in FIG. 8A, dummy discharge is not performed on the nozzle row Na (dummy discharge non-driving).

As described above, when dummy discharge operation is performed on the nozzle row Na and the nozzle row Nb, dummy discharge droplets are discharged at different timings from the adjacent nozzle rows Na and Nb.

Such a configuration can reduce scattering of mist when dummy discharge is performed from multiple nozzles into the suction cap 82*a*.

In such a case, as illustrated in FIG. 8, a period of time in which dummy discharge operation does not overlap between the adjacent nozzle rows Na and Nb is set, thus more reliably reducing scattering of mist.

Figure 9A:
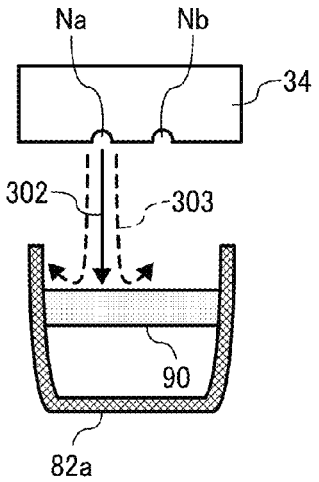
FIGS. 9A and 9B are schematic views of in-cap dummy discharge operation in the first embodiment.
Figure 9B:
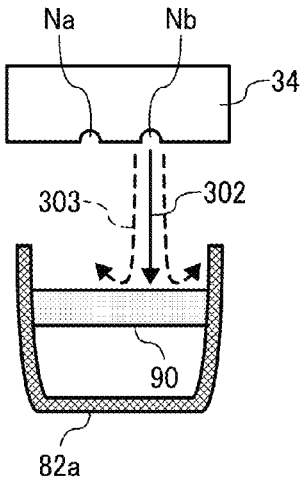
Figure 10A:
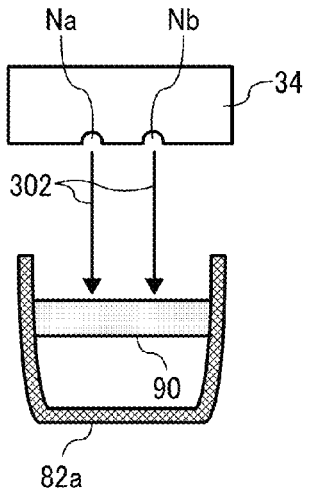
FIGS. 10A and 10B are schematic views of in-cap dummy discharge operation in a first comparative example.
Figure 10B:
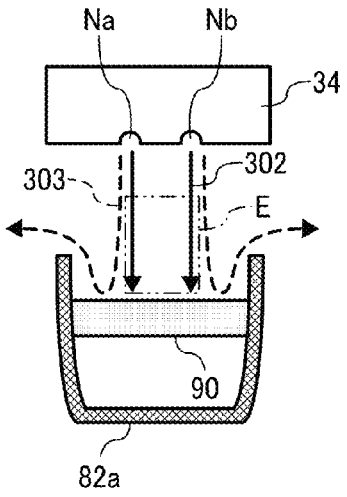
Figure 11:
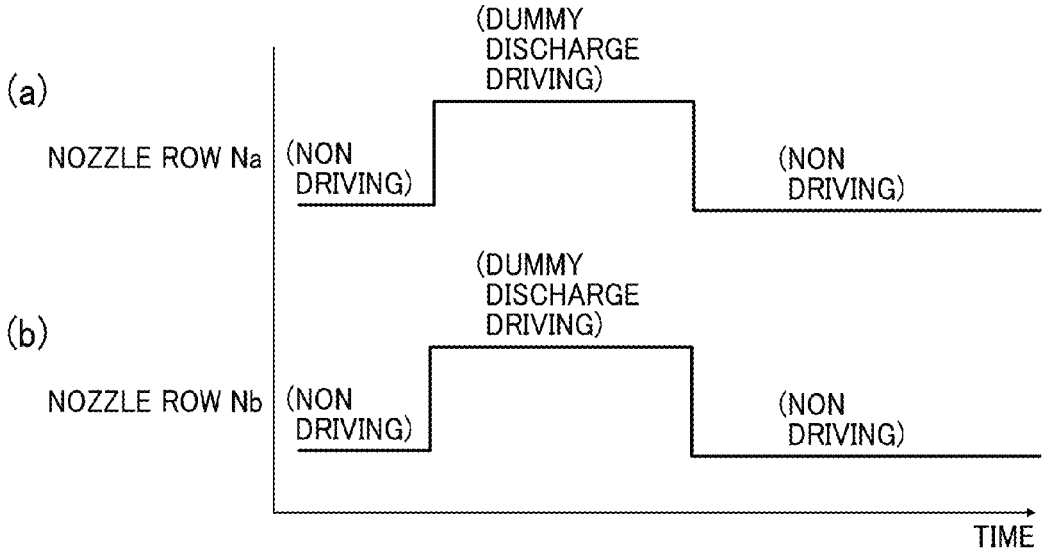
FIG. 11 is a timing charge of in-cap dummy discharge operation in the first comparative example.

Next, an operation effect of this embodiment is described with reference to FIGS. 9A to 11. FIGS. 9A and 9B are schematic views of in-cap dummy discharge operation in this embodiment. FIGS. 10A and 10B are schematic views of in-cap dummy discharge operation in a first comparative example. FIG. 11 is a timing charge of the in-cap dummy discharge operation in the first comparative example.

For the first comparative example, as illustrated in FIGS. 10A and 11, adjacent nozzle rows Na and Nb are simultaneously driven to discharge dummy discharge droplets 302. One reason of this operation is that, when a single recording head 34 includes multiple nozzle rows, simultaneous dummy discharge from the multiple nozzle rows can shorten a dummy discharge time. The phrase "driving of the nozzle rows" used herein means driving of pressure generators corresponding to nozzles of the nozzle rows.

However, when dummy discharge is simultaneously performed from adjacent multiple nozzle rows into a cap, as illustrated in FIG. 10B, dummy discharge causes air flows Here, in an area E between adjacent dummy discharge droplets 302 illustrated in FIG. 10B, air flows generated by flying of dummy discharge droplets from the nozzle rows Na and Nb repel each other, thus causing air flows spreading outward over wide areas. As a result, mist 303 scatters outside the suction cap 82*a*.

As described above, if mist scatters inside the image forming apparatus, mist may contaminate components inside the image forming apparatus and adhere to an encoder sheet that detects the position of the carriage 33, thus causing a reading error and hampering correct control.

By contrast, in this embodiment, as described above, dummy discharge timing differs from each other between the adjacent the nozzle rows. In other words, in this embodiment, as illustrated in FIG. 9A, when dummy discharge is performed from the nozzle row Na, dummy discharge is not performed from the nozzle row Nb, thus reducing air flows spreading over wide areas outside the suction cap 82*a*. Likewise, as illustrated in FIG. 9B, when dummy discharge is performed from the nozzle row Nb, dummy discharge is not performed from the nozzle row Na, thus reducing air flows spreading over wide areas outside the suction cap 82*a*.

Such a configuration reduces the amount of mist scattered from the suction cap 82*a* inside the image forming apparatus.

Next, in this embodiment, as illustrated in FIGS. 7A and 7B, dummy discharge is performed at positions so as not to overlap a center position β of the suction cap 82*a* in the nozzle-row arranged direction D3.

Such a configuration can shorten the time for in-cap dummy discharge operation.

Figure 12A:
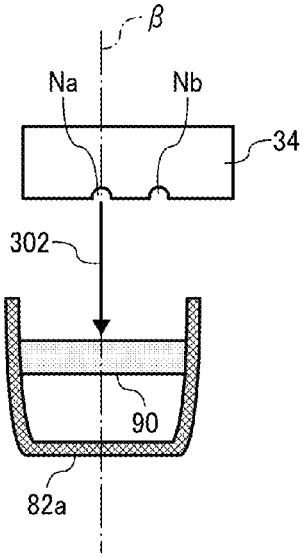
FIGS. 12A, 12B, and 12C are schematic views of dummy discharge operation in a second comparative example.
Figure 12B:
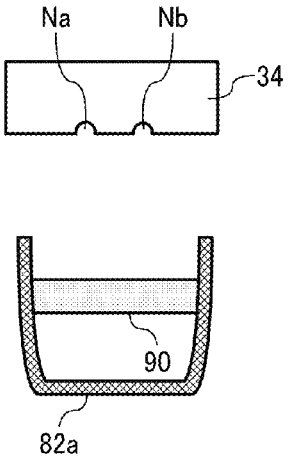
Figure 12C:
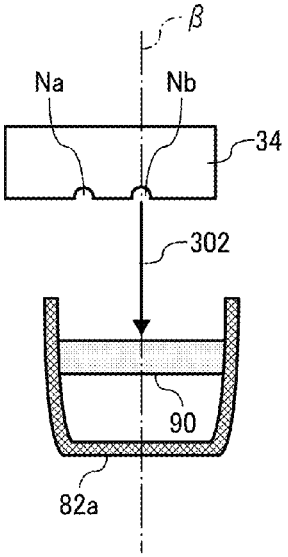
Figure 13:
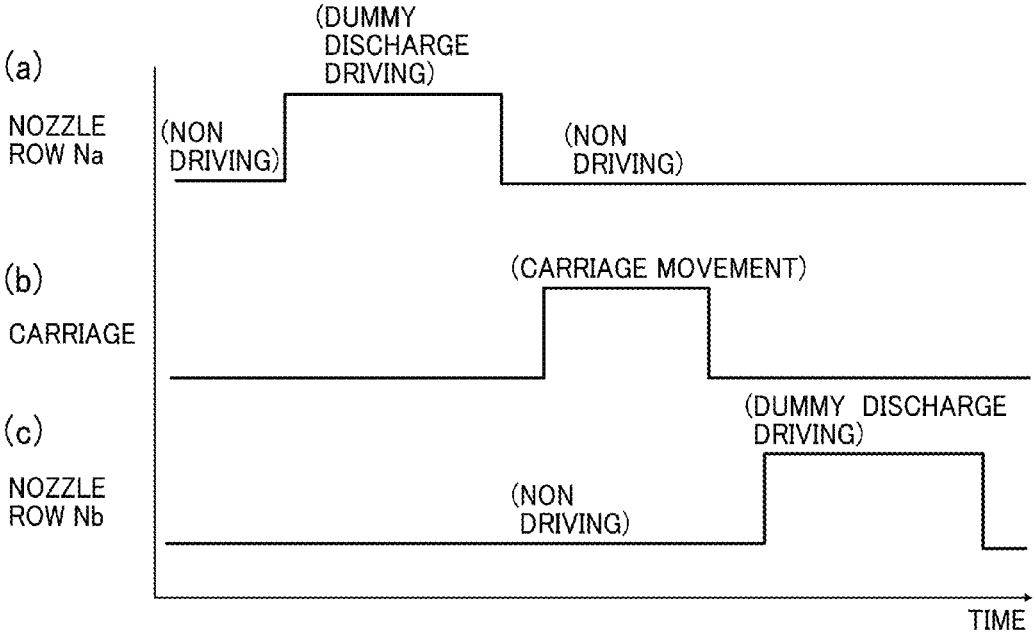
FIG. 13 is a timing chart of dummy discharge operation in the second comparative example.

The feature is further described below with reference to FIGS. 12A, 12B, 12C, and 13. FIGS. 12A, 12B, and 12C are schematic views of dummy discharge operation in a second comparative example. FIG. 13 is a timing chart of dummy discharge operation in the second comparative example.

In the second comparative example, dummy discharge timing differs between adjacent nozzle rows Na and Nb, and dummy discharge is performed at a center position β of a suction cap 82*a* in the nozzle-row arranged direction D3.

In other words, dummy discharge is performed with the nozzle row Na of a recording head 34 moved to the center position β of the suction cap 82*a*. Then, with the nozzle row Nb of the recording head 34 moved to the center position β of the suction cap 82*a*, dummy discharge is performed.

However, as in the second comparative example, if each of the nozzle rows Na and Nb is moved to the center position β of the suction cap 82*a* to perform dummy discharge from each of the nozzle rows Na and Nb, the time for dummy discharge operation (maintenance time) would increase by a time for moving the carriage. In particular, as the number of nozzle rows increase, the time for moving the carriage significantly increases.

Here, for a single in-cap dummy discharge operation (single maintenance operation), dummy discharge is performed from both the nozzle row Na and the nozzle row Nb to maintain the degree of dry of liquid in the vicinity of nozzles substantially equal to each other.

Hence, for this embodiment, in the nozzle-row arranged direction D3, dummy discharge is performed at the position (shifted by a distance γ1 in FIGS. 7A and 7B) at which each of the nozzle rows Na and Nb does not overlap the center position β of the suction cap 82*a*.

With such a configuration, dummy discharge is performed from each of the nozzle rows Na and Nb with the recording head 34 moved at a position opposing the suction cap 82*a*, thus allowing dummy discharge to be performed without movement of the carriage and shortening the maintenance time for dummy discharge operation.

Figure 14A:
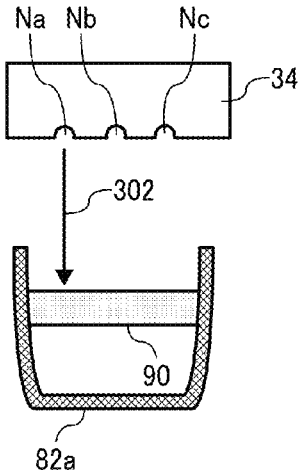
FIGS. 14A to 14C are schematic views of in-cap dummy discharge operation in a second embodiment of this disclosure.
Figure 14B:
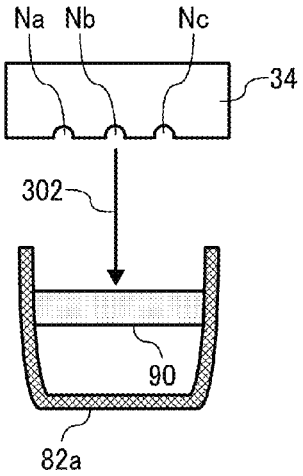
Figure 14C:
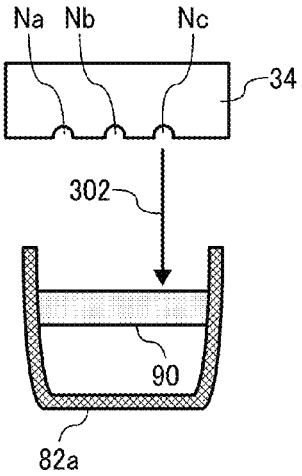

Next, a second embodiment of the present disclosure is described with reference to FIGS. 14A to 14C. FIGS. 14A to 14C are schematic views of in-cap dummy discharge operation in the second embodiment.

In this embodiment, a recording head 34 includes three nozzle rows, i.e., a nozzle row Na, a nozzle row Nb, and a nozzle row Nc.

When dummy discharge operation is performed, dummy discharge droplets are discharged at different timings in an order of the nozzle row Na, the nozzle row Nb, and the nozzle row Nc.

In such a case, when the recording head 34 is moved to oppose a suction cap 82*a*, dummy discharge is performed at a position at which the nozzle row Nb at a middle of the nozzle rows Na, Nb, and Nc overlaps a center position β of the suction cap 82*a*.

Figure 15A:
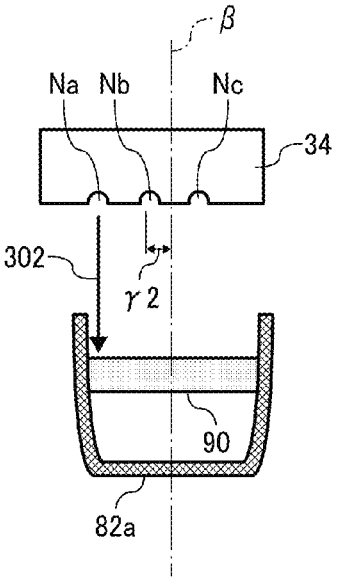
FIGS. 15A to 15C are schematic views of in-cap dummy discharge operation in a third embodiment of this disclosure.
Figure 15B:
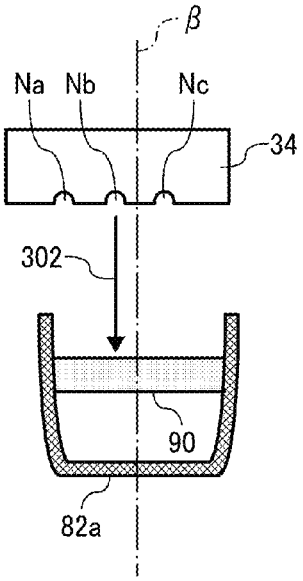
Figure 15C:
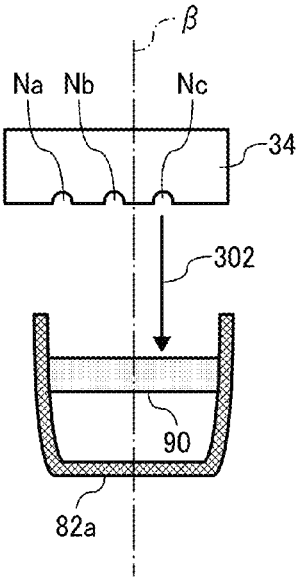

Next, a third embodiment of the present disclosure is described with reference to FIGS. 15A to 15C. FIGS. 15A to 15C are schematic views of in-cap dummy discharge operation in the third embodiment.

For this embodiment, in the configuration of the above-described second embodiment, when the recording head 34 is moved to oppose the suction cap 82*a* to perform dummy discharge, the nozzle row Nb is placed at a position shifted by a distance γ2 from the center position β of the suction cap 82*a*.

Dummy discharge droplets are discharged at different timings in an order of the nozzle row Na, the nozzle row Nb, and the nozzle row Nc.

Figure 16A:
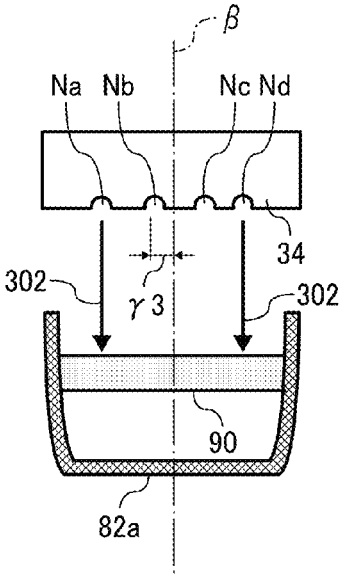
FIGS. 16A to 16C are schematic views of in-cap dummy discharge operation in a fourth embodiment of this disclosure.
Figure 16B:
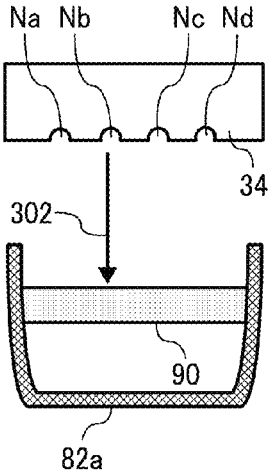
Figure 16C:
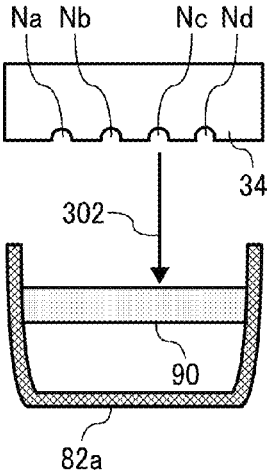

Next, a fourth embodiment of the present disclosure is described with reference to FIGS. 16A to 16C. FIGS. 16A to 16C are schematic views of in-cap dummy discharge operation in the fourth embodiment.

In this embodiment, a recording head 34 includes four nozzle rows, i.e., a nozzle row Na, a nozzle row Nb, a nozzle row Nc, and a nozzle row Nd.

When dummy discharge operation is performed, as illustrated in FIG. 16A, dummy discharge is simultaneously performed from the nozzle rows Na and Nd not adjacent to each other, and dummy discharge is not performed from the nozzle row Nb and Nc adjacent to each other. When the nozzle rows from which dummy discharge simultaneously is performed are not adjacent to each other, air flows in the above-described area E do not so much repel each other, and mist is not so much scattered outside the cap 82*a*.

Then, as illustrated in FIGS. 16B and 16C, for example, dummy discharge is performed at different timings in an order of the nozzle row Nb and the nozzle row Nc.

For this embodiment, the nozzle rows Na, Nb, Nc, and Nd are arranged at regular intervals. When the recording head 34 is moved to oppose the suction cap 82*a* to perform dummy discharge, the nozzle row Nb is placed at a position shifted by a distance γ3 from the center position β of the suction cap 82*a* (where the interval between the adjacent nozzle rows is 2×γ3).

Such a configuration can reduce scattering of mist while suppressing an increase in the time for dummy discharge operation with a greater number of nozzle rows.

In another embodiment, instead of the above-described order, for example, dummy discharge is simultaneously discharged from the nozzle row Na and the nozzle row Nc. At this time, dummy discharge is not performed from the nozzle row Nb and the nozzle row Nc. Then, dummy discharge is simultaneously performed from the nozzle row Nb and the nozzle row Nd. At this time, dummy discharge is not performed from the nozzle row Na and the nozzle row Nd.

Such a configuration can further reduce scattering of mist while suppressing an increase in the time for dummy discharge operation.

As in the above-described first embodiment, dummy discharge may be performed in nozzle rows from the nozzle row Na, the nozzle row Nb, the nozzle row Nc, and the nozzle row Nd.

Figure 17:
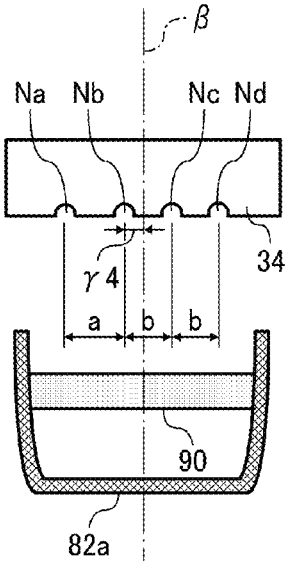
FIG. 17 is a schematic view of a recording head and a suction cap in dummy discharge operation in a fifth embodiment of this disclosure.

Next, a fifth embodiment of the present disclosure is described with reference to FIG. 17. FIG. 17 is a schematic view of a recording head 34 and a suction cap 82*a* in dummy discharge operation in the fifth embodiment.

In this embodiment, the recording head 34 includes the nozzle row Na, the nozzle row Nb, the nozzle row Nc, and the recording head 34. An interval a between the nozzle rows Na and Nb is greater than an interval b between the nozzle row Nb and the nozzle row Nc or between the nozzle row Nc and the nozzle row Nd.

For this embodiment, when the recording head 34 is moved to oppose the suction cap 82*a* to perform dummy discharge, the nozzle row Nb is placed at a position shifted by a distance γ4 from a center position β of a suction cap 82*a*.

Figure 18:
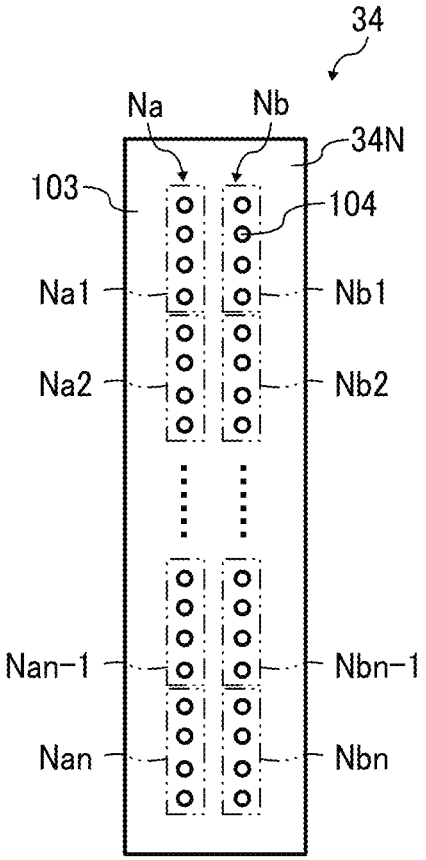
FIG. 18 is a schematic view of a nozzle formed face of a recording head in a sixth embodiment of this disclosure.

Next, a sixth embodiment of the present disclosure is described with reference to FIG. 18. FIG. 18 is a schematic view of a nozzle formed face 34N of a recording head 34 in the sixth embodiment.

In this embodiment, nozzles of a nozzle row Na are divided into nozzle groups Na1 through Nan, and dummy discharge operation is performed in nozzle groups. Similarly, nozzles of a nozzle row Nb is divided into nozzle groups Nb1 through Nbn, and dummy discharge operation is performed in nozzle groups.

An example of control of dummy discharge operation in this embodiment is described with reference to FIG. 19.

Figure 19:
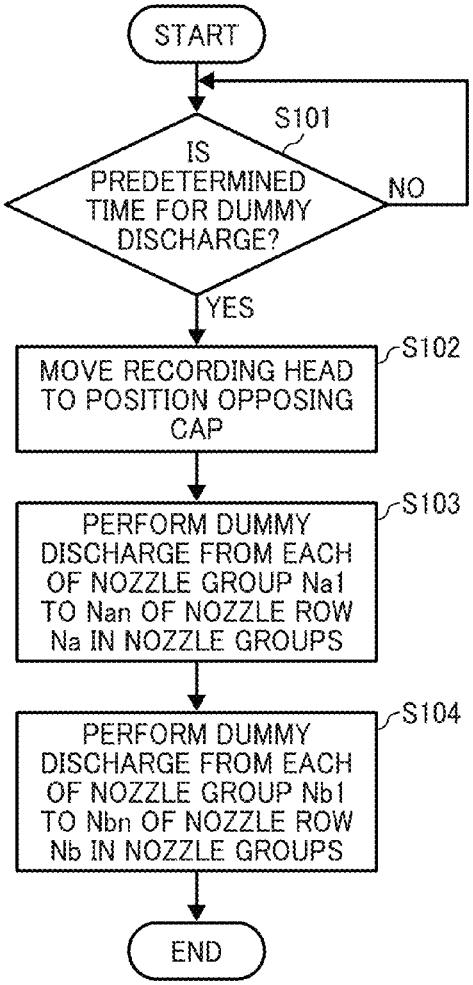
FIG. 19 is a flow chart of an example of control of dummy discharge operation in the sixth embodiment.

In FIG. 19, at S101 a controller 500 determines whether it is a predetermined time at which dummy discharge operation is to be performed (a predetermined condition occurs). When the controller 500 determines that it is the predetermined time for dummy discharge operation (YES at S101), at S102 a recording head 34 is moved to a position opposing a suction cap 82*a*.

At S103, dummy discharge is performed in turn from, for example, the nozzle group Na1 to the nozzle group Nan of the nozzle row Na.

At S104, dummy discharge is performed in turn from the nozzle group Nb1 to the nozzle group Nbn of the nozzle row Nb.

In the above-described configuration, for example, dummy discharge can be controlled to be performed from, first, the nozzle group Na1 only, and then simultaneously from, e.g., the nozzle group Na2 and the nozzle group Nb1. Likewise, dummy discharge is sequentially performed in nozzle groups from respective nozzle rows Na and Nb while shifting one nozzle group in each nozzle row, and finally from the nozzle group Nbn only. Thus, the operation is finished.

In other words, dummy discharge operation is performed in nozzle groups, and dummy discharge is performed at different timings between nozzle groups of adjacent nozzle rows.

Figure 20:
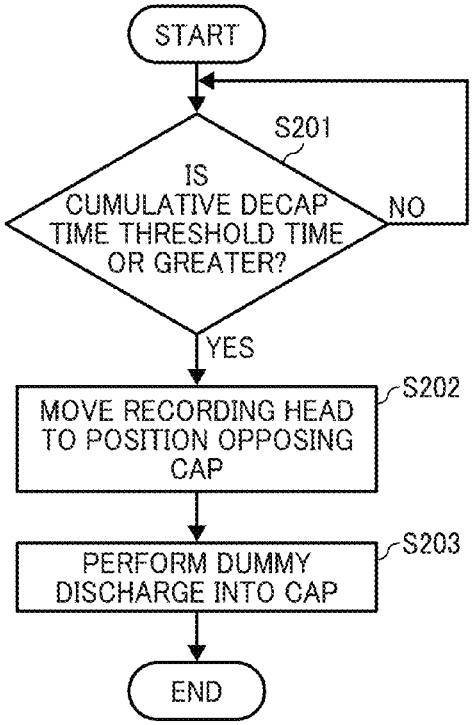
FIG. 20 is a flow chart of control of dummy discharge operation in a seventh embodiment of this disclosure.

Next, a seventh embodiment of the present disclosure is described with reference to FIG. 20. FIG. 20 is a flow chart of control of dummy discharge operation in the seventh embodiment.

In FIG. 20, when the controller 500 determines that a cumulative time of a non-capping time (decap time) during which a nozzle formed face 34N of a recording head 34 is not capped with a suction cap 82*a* is greater than a threshold time (YES at S201), at S202 the recording head 34 is moved to a position opposing the suction cap 82*a* and at S203 dummy discharge operation is performed into the suction cap 82.

Such a configuration can maintain an absorber 90 of the suction cap 82*a* in a moisturizing state while preventing waste dummy discharge. Accordingly, loss of moisture of ink in nozzles due to dry of the absorber 90 and occurrence of discharge failure due to an increase in viscosity of ink can be prevented.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a liquid ejection head having plural nozzle rows in a nozzle formed face thereof, each of the plural nozzle rows including multiple nozzles through which droplets are discharged;

a cap to cap the nozzle formed face of the liquid ejection head; and a dummy discharge controller to control a dummy discharge operation to discharge dummy discharge droplets not contributing to image formation from the nozzles with the nozzle formed face opposed to the cap, wherein the dummy discharge controller controls the liquid ejection head to discharge the dummy discharge droplets at different timings between adjacent nozzle rows of the plural nozzle rows in the dummy discharge operation, and wherein, in the dummy discharge operation, the plural nozzle rows are shifted from a center position of the cap in a direction in which the plural nozzle rows are arranged side by side.

2. The image forming apparatus according to claim 1, wherein the dummy discharge controller controls the liquid ejection head to perform the dummy discharge operation in nozzle groups, each of the nozzle groups including two or more nozzles.

3. An image forming apparatus, comprising:

a liquid ejection head having plural nozzle rows in a nozzle formed face thereof, each of the plural nozzle rows including multiple nozzles through which droplets are discharged;

a cap to cap the nozzle formed face of the liquid ejection head; and a dummy discharge controller to control a dummy discharge operation to discharge dummy discharge droplets not contributing to image formation from the nozzles with the nozzle formed face opposed to the cap, wherein the dummy discharge controller controls the liquid ejection head to discharge the dummy discharge droplets at different timings between adjacent nozzle rows of the plural nozzle rows in the dummy discharge operation, and wherein the dummy discharge controller controls a period of time in which the dummy discharge operation is performed not to overlap between the adjacent nozzle rows of the plural nozzle rows.

4. An image forming apparatus, comprising:

a liquid ejection head having plural nozzle rows in a nozzle formed face thereof, each of the plural nozzle rows including multiple nozzles through which droplets are discharged;

a cap to cap the nozzle formed face of the liquid ejection head; and a dummy discharge controller to control a dummy discharge operation to discharge dummy discharge droplets not contributing to image formation from the nozzles with the nozzle formed face opposed to the cap, wherein the dummy discharge controller controls the liquid ejection head to perform the dummy discharge operation in nozzle groups, each of the nozzle groups including two or more nozzles, and to discharge the dummy discharge droplets at different timings between nozzle groups of adjacent nozzle rows of the plural nozzle rows in the dummy discharge operation, and wherein, in the dummy discharge operation, the plural nozzle rows are shifted from a center position of the cap in a direction in which the plural nozzle rows are arranged side by side.

* * * * *